US007640856B2

(12) United States Patent
Deslangle

(10) Patent No.: US 7,640,856 B2
(45) Date of Patent: Jan. 5, 2010

(54) METHOD FOR CONTROLLING THE FEEDING OF A WEB SUBSTRATE INTO A PRINTING PRESS

(75) Inventor: Dominique Deslangle, Orleans (FR)

(73) Assignee: Goss International Montataire, SA, Montataire (FR)

( * ) Notice: Subject to any disclaimer, the term of this patent is extended or adjusted under 35 U.S.C. 154(b) by 397 days.

(21) Appl. No.: 10/579,190

(22) PCT Filed: Nov. 16, 2004

(86) PCT No.: PCT/IB2004/003751

§ 371 (c)(1),
(2), (4) Date: May 15, 2006

(87) PCT Pub. No.: WO2005/049462

PCT Pub. Date: Jun. 2, 2005

(65) Prior Publication Data

US 2007/0084364 A1 Apr. 19, 2007

(30) Foreign Application Priority Data

Nov. 21, 2003 (DE) ..... 103 54 432

(51) Int. Cl.

| | |
|---|---|
| ***B41F 1/54*** | (2006.01) |
| ***B41F 1/66*** | (2006.01) |
| ***B41F 13/54*** | (2006.01) |
| ***B41F 5/02*** | (2006.01) |
| ***B41L 5/12*** | (2006.01) |
| ***B41L 39/00*** | (2006.01) |
| ***B41L 47/56*** | (2006.01) |

(52) U.S. Cl. ..... 101/484; 101/228

(58) Field of Classification Search ..... 101/216, 101/219, 231, 484, DIG. 42, 228; 226/42, 226/24

See application file for complete search history.

(56) References Cited

U.S. PATENT DOCUMENTS

| | | | | |
|---|---|---|---|---|
| 4,369,906 | A | 1/1983 | Isherwood | |
| 5,062,360 | A * | 11/1991 | Germann et al. | 101/152 |
| 5,485,386 | A | 1/1996 | Andreasson | 364/471 |
| 5,709,331 | A | 1/1998 | Lam et al. | 226/4 |
| 6,092,466 | A * | 7/2000 | Koch et al. | 101/485 |
| 6,186,064 | B1 * | 2/2001 | Dufour | 101/181 |
| 6,334,564 | B1 * | 1/2002 | Kishine et al. | 226/42 |
| 7,322,291 | B2 * | 1/2008 | Gretsch et al. | 101/483 |

FOREIGN PATENT DOCUMENTS

| | | |
|---|---|---|
| DE | 31 23 587 A1 | 3/1982 |
| EP | 1 065 161 A2 | 4/2000 |
| JP | 60171962 | 9/1985 |

* cited by examiner

*Primary Examiner*—Judy Nguyen
*Assistant Examiner*—Leo T Hinze
(74) *Attorney, Agent, or Firm*—Davidson, Davidson & Kappel, LLC

(57) ABSTRACT

A method for controlling the feeding of a web substrate into a printing press, in particular a rotary press, the web substrate being fed with a web tension into the printing press and a printing length to be achieved being specified. A current printing length of the printing press is determined. The web tension is varied by varying the length of the web substrate fed during one time interval as a function of the deviation of the current printing length from the printing length to be achieved.

7 Claims, 3 Drawing Sheets

METHOD FOR CONTROLLING THE FEEDING OF A WEB SUBSTRATE INTO A PRINTING PRESS

The present invention is directed to a method for controlling the feeding of a web substrate into a printing press, a web substrate being fed with a web tension into the printing press and a printing length to be achieved being specified.

BACKGROUND

In web-processing printing presses, in particular offset presses, whether they process one web substrate or a plurality of web substrates, given an elastic deformation of the web substrate, there is a linear relationship between the web tension and the web elongation or web stretch (deformation). The web tension of a specific web substrate is generally also dependent on the processing parameters of the printing press and of the printing substrate. For example, the type of rubber blankets used, the number of print units in thrown-on impression mode, and the type of printing substrate used, in particular paper, must be specified or considered. In practice, the web tension for infeeding the web substrate during operation of the printing press is typically varied in reaction to the actually occurring web tension in the superstructure upstream of a folding apparatus, until a desired or specified web tension is reached: when the web substrate is too slack, the web tension is increased; when the web substrate is stretched too tightly, the web tension is reduced. In this context, the decision whether to increase or reduce the web tension is often made by the printer or the machine operator and is, therefore, largely based on his/her experience. Setting the web tension to a correct value is vitally important to a proper functioning of the printing press.

A method and a device for controlling the elongation of a moving web substrate are known from U.S. Pat. No. 5,709,331. From a length change or a speed change occurring at a drive roller, the current web elongation is calculated, and when this current web elongation deviates from a desired elongation, the web tension is corrected to the desired value. In the process, there is no need to know the exact value of the elasticity modulus of the web substrate, since the relative deviation and thus a necessary correction can be directly ascertained. The method can be implemented using a web tensioning device of an unwind unit (or of reel changer). The web tension can be varied by using a dancer roller or web tension roller, which exerts a force on the web substrate.

BRIEF SUMMARY OF THE INVENTION

An object of the present invention is to devise a method for controlling the feeding of a web substrate into a printing press, which will enable a web tension necessary for operating a printing press and a web elongation associated therewith to be adjusted in a simple manner in conformance with specifications.

In accordance with the present invention, in the method for controlling the feeding of a web substrate into a printing press, in particular a rotary press and/or an offset press and/or a rotary offset press, the web substrate is fed with a web tension into the printing press, and a printing length to be achieved is specified. A current printing length of the printing press is determined. The web tension for the web infeed is varied by varying the length of the web substrate fed during one time interval as a function of the deviation of the current printing length (actual value) from the printing length (nominal value) to be achieved.

In the context of this description, printing length is understood to be that length on the web substrate which is covered, in particular printed on, by a one-time rolling off of a blanket cylinder or transfer printing cylinder (with or without slippage, with or without compression of the rubber blanket). It is immediately clear to one skilled in the art that the thus defined printing length also represents a measure for the size of the printing subject in the context of a one-time printing on the printing substrate.

The method according to the present invention leads to the infeeding of the web substrate being adjusted in such a way that the requisite web tension is produced in the web substrate that is fed within one time interval, in order to achieve a successful operation of the printing press. The essential condition for a printing press to produce a finished printing product that correctly conforms with the specifications is that the current printing length of the web properly match the printing length to be attained, and/or that the current printing lengths of all participating webs be identical.

The current printing length is dependent on the current web elongation or deformation and on the current web tension. More precisely, a linear or directly proportional relationship between the web tension and the printing length may be assumed according to the method of the present invention. The dependency, in particular the linear relationship, may be parameterized as a function of the type of printing substrate and/or the type of rubber blanket used. In other words, a change in the web tension for the web infeed effects a change, in particular a proportional variation, in the current printing length. The present invention is based, inter alia, on the idea that the determination of the current printing length is a measure or an indication of the quantity or the length of the printing substrate that is fed into the printing press within one time interval. This measure is utilized or evaluated to determine the necessary web tension to enable it to be controlled or regulated.

The method according to the present invention may be applied or implemented in printing presses which process one web substrate or in printing presses which process a plurality of web substrates, for each one of the plurality of web substrates.

In the method according to the present invention, the current printing length may be calculated on the basis of at least one measurement of the angular velocity of a blanket cylinder and of the length of web substrate fed within one time interval. In other words, the idea underlying the present invention includes the measurement of the current printing length. In particular, a plurality of measurements may be taken whose results are averaged, in particular arithmetically averaged. In addition or alternatively thereto, the length of the web substrate fed during one time interval may be calculated on the basis of a measurement of the angular velocity of a feed roller, in particular in an unwind unit or a reel changer.

In one preferred specific embodiment of the method of the present invention, the angular velocity of a feed roller, in particular in an unwind unit or a reel changer, is varied to change the length of the web substrate fed within one time interval. The web tension during the infeed operation is then dependent on the length of the web substrate fed during one time interval.

In the context of the inventive idea, there is also a device for controlling the feeding of a web substrate into a printing press. The device according to the present invention includes an actuator for adjusting the length of web substrate to be fed during one time interval and a computer for calculating the driving of the actuator. In one memory unit of the computer, a program is stored which has at least one part or section which executes a control of the device in accordance with the method of the present invention along the lines of this description. Thus, in particular, it enables a predefined printing length to be stored and a current printing length to be calculated or determined.

The device according to the present invention may be used in a rotary press, in particular a rotary offset press, which processes one or a plurality of web substrates. In other words, a rotary press according to the present invention includes an unwind unit, a reel changer or a take-off unit, a plurality of print units, and at least one device according to the present invention. Alternatively thereto, to process a plurality of web substrates, a rotary press according to the present invention includes a plurality of unwind units, reel changers or of take-off units, a plurality of printing towers having a multiplicity of print units and one device in accordance with the present invention for each of the plurality of web substrates.

The rotary press may be a jobbing press or a newspaper printing press. The rotary press may include one or more dryers and a folding apparatus. The rotary press may be designed for the use of sleeve-shaped rubber blankets, i.e., so-called sleeves. Typical printing substrates are, for example, paper (preferred), cardboard or organic polymer sheeting.

BRIEF DESCRIPTION OF THE DRAWINGS

Further advantages, advantageous embodiments and refinements of the present invention are described with reference to the following figures, as well as their descriptions. Specifically, they show.

DETAILED DESCRIPTION OF A PREFERRED EMBODIMENT

Figure 1:
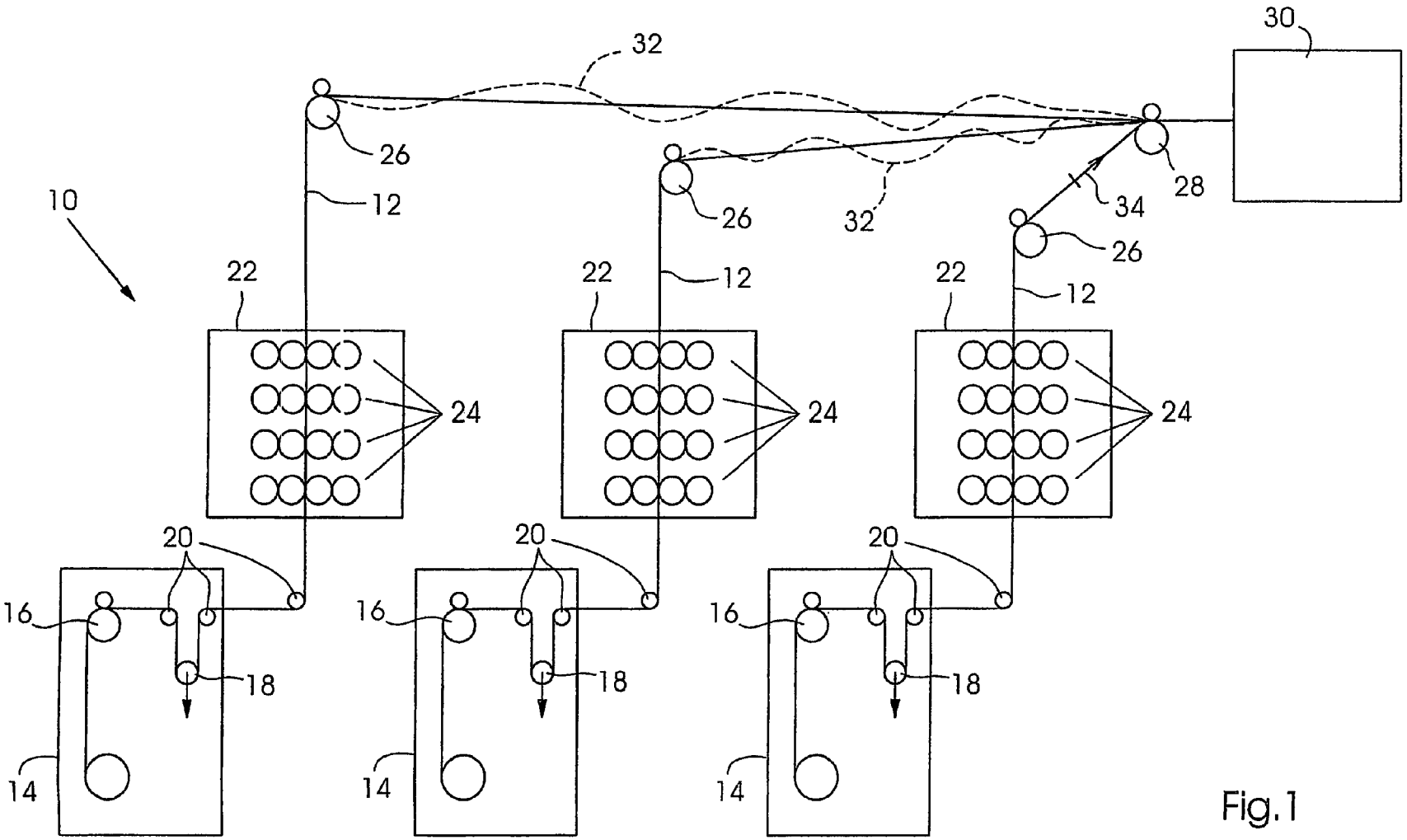
FIG. 1 a schematic representation of a specific embodiment of a printing press having three web substrates.

FIG. 1 shows a schematic representation of a specific embodiment of a printing press having three web substrates. In addition to the actual detailed representation, a few general remarks should also help clarify one preferred embodiment of the present invention.

A printing press 10 having a plurality of web substrates 12 (here three, for example) has print units 24 (in this case, four, for the colors black, cyan, magenta and yellow) for each web substrate 12. Print units 24 may, as shown in FIG. 1, be combined into one printing tower 22 or, as not shown here, but as known to one skilled in the art, be configured in a line. Each one of the plurality of web substrates 12 is fed from an unwind unit 14 via a feed roller 16 and a web tension roller 18 and various guide rollers 20 to print units 24. Printed web substrates 12 are transported by draw rollers 26 in the superstructure to a collecting roller 28, from where superposed web substrates 12 arrive in a folding apparatus 30. In folding apparatus 30, web substrates 12 are cut into signatures or finished printing products, and folded.

The printing substrate in the various web substrates 12 may differ, in particular have different elasticity moduli. In addition, from printing tower 22 to printing tower 22, various combinations of print units 24 may be employed, or different rubber blankets may be used in the individual print units. Moreover, within manufacturing tolerances, rubber blankets of the same type may affect a printing substrate differently. Therefore, the process of predicting or calculating the web tension is difficult or fraught with considerable uncertainty. Since, from time to time, it is necessary to alter the configuration of the printing press for individual print jobs and/or to replace worn-out rubber blankets, it is not immediately clear to the machine operator which adjustment or control of the web tension is needed for feeding the printing substrate. However, an essential condition for consistently producing a finished printing product in folding apparatus 30 is that all participating web substrates 12 have identical printing lengths. The machine operator or the machine control may adjust or control the web tension during the infeed operation. As already mentioned, the web tension, the web elongation (when this is elastic), and the printing length are in a linear relationship.

The printing length is not only linearly dependent on the web tension, but also on properties of the rubber blanket and of the printing substrate, in particular paper. The printing length decreases in response to an increasing web tension. Various printing substrates, for example paper substrates, may have different elasticity moduli. The stiffer the paper, the shorter the printing length is in relationship to the web tension. The properties of the rubber blanket, in particular its elasticity or flexibility, influence the printing length: rubber blankets are frequently classified in various types by specifying a number, a so-called index. The larger this index is, the longer the printing length is.

One example provides for three rubber blankets having different type numbers or indices such that, given 600 newtons of web tension, when feeding in the three corresponding webs, the rubber blanket having the largest index effects a printing length of 760.25 mm, the rubber blanket having the middle index effects a printing length of 759.86 mm, and the rubber blanket having the smallest index effects a printing length of 759.40 mm. Thus, substantial difficulty is entailed in controlling a printing press having a plurality of web substrates in this manner. As a consequence, the tension of the three webs would vary from too slack to too taut in the superstructure. To attain the same printing length of 759.86 mm with all three rubber blankets, the web tension of the web cooperating with the rubber blanket having the largest index must be 900 newtons, and the web tension of the web cooperating with the rubber blanket having the smallest index must be 300 newtons.

FIG. 1 shows in detail both of the situations in the superstructure that are discussed here: web substrates 12 drawn with solid lines correspond to the setting having the correct or desired tension in the superstructure of rotary press 10. Also shown is the state when the tensions in the superstructure differ from one another. A web course of two too slack web substrates 32 is shown exemplarily by a dotted line, and an excessive web tension 34 is shown exemplarily in the third web substrate 12 by an arrow indicating force.

To summarize, in printing presses having a plurality of web substrates 12, in order to achieve a specific, predefined printing length, the individual web substrates 12 must be fed with different web tensions into print units 24 or printing towers 22.

Figure 2:
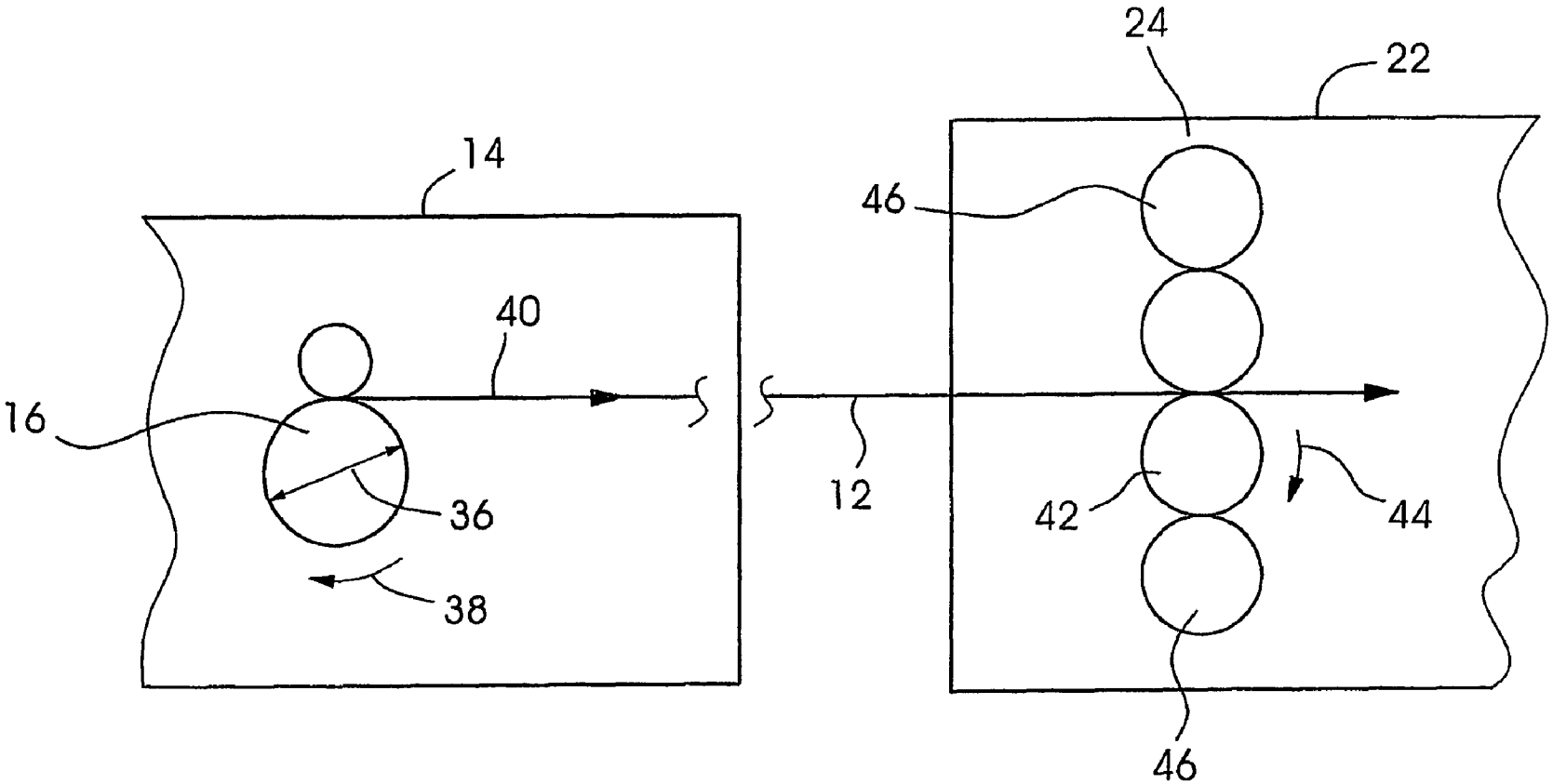
FIG. 2 a representation for clarifying the preferred specific embodiment of the determination of the current printing length in accordance with the present invention.

FIG. 2 is a representation for clarifying the preferred specific embodiment of the method for determining the current printing length in accordance with the present invention. In the preferred specific embodiment, an additional function is assigned to a feed roller 16 of unwind unit 14. The aim here is to measure the quantity or the length of the web substrate fed within one time interval, for example one or more seconds, into the printing press, to make this information available to the operation and control of the printing press. The feed roller has a (precise or precisely enough known) diameter 36, in short d, and rotates with a feed roller angular velocity 38, in short $\omega_1$, so that web substrate 12 has a web tension 40. Web substrate 12 arrives in a printing tower 22, in which a print unit 24 is shown in FIG. 2. Print unit 24 has a blanket cylinder 42, which rotates with a blanket-cylinder angular velocity 44, in short $\omega_2$. Web substrate 12 passes through a printing nip, formed by aforesaid blanket cylinder 42 and another blanket cylinder, both being in rolling contact with printing form cylinders 46 (double printing unit, in particular double offset printing unit, for printing on both sides of the web substrate). If, at this point, feed-cylinder angular velocity 38 and blanket-cylinder angular velocity 44 are each determined by sensors, then current printing length l, also referred to as format, may be determined. For this purpose, feed cylinder 16 is equipped with a driven encoder, blanket-cylinder angular velocity 44 may be determined from the speed of the drive of the printing cylinder. The simple relation is derived for the current printing length:

$$l = \pi d \frac{\omega_1}{\omega_2}$$

The calculation may be performed and averaged for a multiplicity of measurements, for example, 10 or 100 rotations of the blanket cylinder may be used for one measurement or for a plurality of measurements to be averaged. The value determined in this manner may be indicated to the machine operator or printer, to provide him/her with supporting information or a reference to use for the adjustment and the necessary measures to undertake. An especially suitable representation is the so-called relative increase in paper, which is defined as the quotient of the difference between the current printing length and the theoretical printing length, and the theoretical printing length multiplied by 100. In addition to these representations, the web tension is also indicated during the infeed operation.

The described procedure may be carried out, in particular, for each individual web substrate in a printing press having a plurality of web substrates. It is clear to one skilled in the art that slippage at the feed roller is avoided by a proper wrapping of web substrate 12 around feed roller 16 and a proper adherence of web substrate 12 to feed roller 16, so that the measurement of the angular velocity provides a representative value for the supplied length of web substrate 12.

Figure 3:
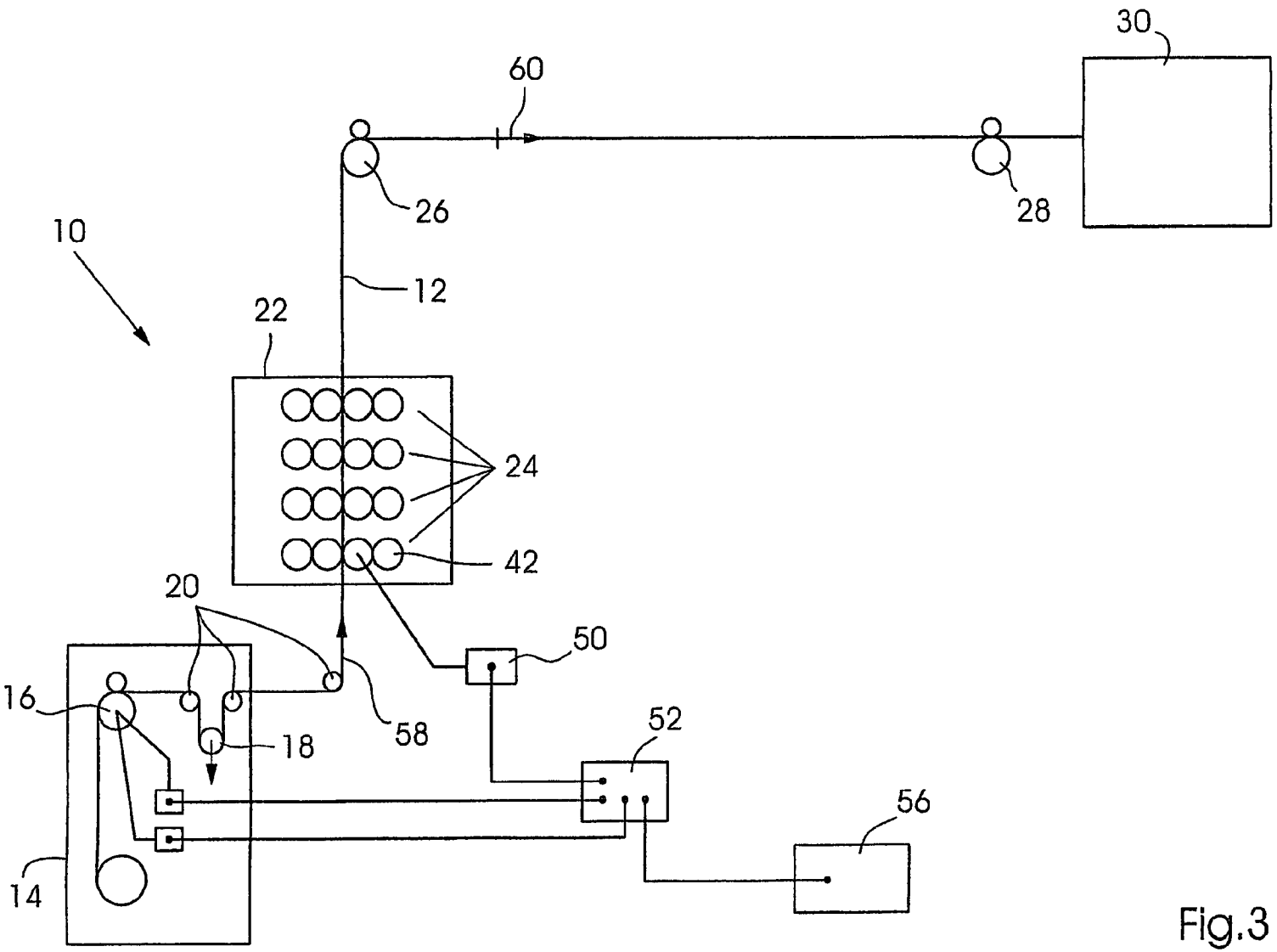
FIG. 3 a schematic representation of a specific embodiment of a printing press having the device according to the present invention for controlling the infeeding of the web substrate.

FIG. 3 relates schematically to one specific embodiment of a printing press 10 having the device according to the present invention for controlling the infeeding of web substrate 12. Without limiting the general interrelationship in accordance with the present invention of a plurality of web substrates, here only that part of a printing press 10 for a web substrate 12 is shown. A web substrate 12 is fed from an unwind unit 14 via a feed roller 16 and guide rollers 20 with a feed tension 58 to a printing tower 22 having print units 24. From printing tower 22, web substrate 12 arrives with a web tension 60 in the superstructure via a draw roller 26 and a collecting roller 28 provided for other web substrates 12 into a folding apparatus 30. The angular velocity of feed roller 16 is measured by a feed roller angular-velocity sensor 48. The angular velocity of a blanket cylinder 42 of a print unit 24 is measured by a blanket cylinder angular-velocity sensor 50. The measured values are transferred to a computer 52 for analysis and processing, in particular to determine the current printing length and to compare it to a predefined printing length. In one memory unit, computer 52 has a program for controlling the infeeding of web substrate 12. Using the program, it is possible to determine or calculate the current printing length, as described above and in particular with reference to FIG. 2. In other words, the method according to the present invention is implemented by the program. The value of the current printing length may be visually represented to the machine operator or printer by a readout or display device 56, for example a monitor or a display element. Moroever, computer 52 is operatively connected to an actuator 54 by control command and/or data exchange. The angular velocity of feed roller 16 may be varied or adjusted by actuator 54. Thus, a device for controlling the infeeding of web substrate 12 is realized in this manner.

REFERENCE NUMERAL LIST

10 rotary press
12 web substrate
14 unwind unit
16 feed roller
18 web tension roller
20 guide rollers
22 printing tower
24 print units
26 draw roller
28 collecting roller
30 folding apparatus
32 slack web substrate
34 excessive web tension
36 feed roller diameter
38 feed-roller angular velocity
40 web tension
42 blanket cylinder
44 blanket-cylinder angular velocity
46 printing form cylinder
48 feed roller angular-velocity sensor
50 blanket cylinder angular-velocity sensor
52 computer
54 actuator
56 display device
58 feed tension
60 web tension in the superstructure

The invention claimed is:

1. A method for controlling the feeding of a web substrate into a printing press comprising the steps of:

feeding the web substrate with a web tension into the printing press via a feed cylinder having a diameter d;

specifying a printing length to be achieved;

determining an angular velocity $\omega_1$ of the feed cylinder;

determining an angular velocity $\omega_2$ of a blanket cylinder in the printing press which receives the web;

determining a current printing length l of the printing press by calculating $$l = \pi d \frac{\omega_1}{\omega_2};$$

and varying the web tension by varying a length of the web substrate fed during one time interval as a function of a deviation of a current printing length from the printing length to be achieved.

2. The method as recited in claim 1 wherein varying the length of the web substrate fed during one time interval includes varying the angular velocity of a feed roller.

3. The method as recited in claim 1 wherein a relationship between the web tension and the current printing length is a linear relationship.

4. The method as recited in claim 3 further comprising parameterizing the linear relationship as a function of a type of printing substrate or a type of rubber blanket used.

5. A device for controlling the feeding of a web substrate into a printing press comprising:

an actuator for adjusting the length of web substrate to be fed during one time interval;

a computer for calculating a driving of the actuator;

a memory unit of the computer; and a program stored in the memory unit;

the program having at least one part executing a control of the device in accordance with the method as recited in claim 1.

6. A rotary press comprising:

an unwind unit;

a plurality of print units; and at least one device as recited in claim 5.

7. A rotary press for processing a plurality of web substrates comprising:

a plurality of unwind units;

printing towers having a plurality of print units, and a device as recited in claim 5 for each of the web substrates.

* * * * *